United States Patent [19]

Carlin

[11] 4,129,140

[45] Dec. 12, 1978

[54] AUTOMATIC FLUSHING DEVICE

[76] Inventor: Richard D. Carlin, 4799 Primavera La., Las Vegas, Nev. 89122

[21] Appl. No.: 795,327

[22] Filed: May 9, 1977

[51] Int. Cl.[2] ..... F04F 10/00

[52] U.S. Cl. ..... 137/124; 62/171; 137/132; 137/140; 137/546; 261/27; 261/97; 261/DIG. 46; 417/12; 417/40; 417/44

[58] Field of Search ..... 62/171; 137/124, 127, 137/132, 133, 134, 140, 546, 565; 261/27, 36 R, 97, 103, DIG. 46; 417/12, 40, 44

[56] References Cited

U.S. PATENT DOCUMENTS 2,828,761 4/1958 Weibert ..... 137/132

FOREIGN PATENT DOCUMENTS 482628 12/1975 U.S.S.R. ..... 137/132

*Primary Examiner*—Gerald A. Michalsky
*Attorney, Agent, or Firm*—Seiler & Quirk

[57] ABSTRACT

An automatic flushing device for an evaporative cooling system contains a water sump, circulating pump, and float-operated water makeup source. A small, adjustable portion of the return flow enters a separate timing reservoir. When the timing reservoir is full, water from the well and the sump are flushed from the system through a siphon tube which communicates with both chambers.

8 Claims, 5 Drawing Figures

AUTOMATIC FLUSHING DEVICE

BACKGROUND OF THE INVENTION

Evaporative coolers are commonly used in hot, dry climates to reduce air temperatures. In recent years, these coolers have found commercial acceptance as precoolers for air conditioners, being attached immediately upstream of the refrigeration unit air intake.

Especially in desert areas, water used in the coolers is very hard, containing large quantities of dissolved salts. As the water evaporates, the salts concentrate, and scaling occurs in the tubing, on the walls of the sump, and on the distributive tray and pad of the cooler. Periodic flushing of the system is required to prevent salt accumulation and maintain operating efficiency of the cooler.

A self-flushing device for evaporative coolers is disclosed in Weibert, U.S. Pat. No. 2,828,761, issued Apr. 1, 1958. This device consists of a sump having a siphon reservoir which fills with circulating water when the pump is shut off; water from the pump lines flow by gravity back into the siphon reservoir, filling it to the level of the top of the siphon tube. As the siphon empties the reservoir, water from the main sump flows into the siphon reservoir through a one-way valve. While this device is effective for flushing the system, it requires shutting off the pump to actuate the flushing mechanism.

It is an object of this invention to provide an automatic flushing system for an evaporative cooler which will flush the system according to a predetermined, adjustable schedule and which is easy to clean and service. It is a further object to provide a device which will automatically flush the system whenever the circulating pump is shut off. It is a further object of the invention to provide a cooler sump which requires relatively small amounts of water, conserving water usage and obviating health hazards found in large stagnant bodies of water.

SUMMARY OF THE INVENTION

In an evaporative cooling system comprising a water sump, circulating pump, and automatic water level control, the improvement comprising a timing reservoir adjacent to the sump, means for constantly supplying a small portion of circulating water to the timing reservoir, and a siphon drain having inlet means located in both the sump and the timing reservoir such that both are drained when the level of water in either chamber reaches a predetermined level.

DETAILED DESCRIPTION OF THE INVENTION

Figure 1:
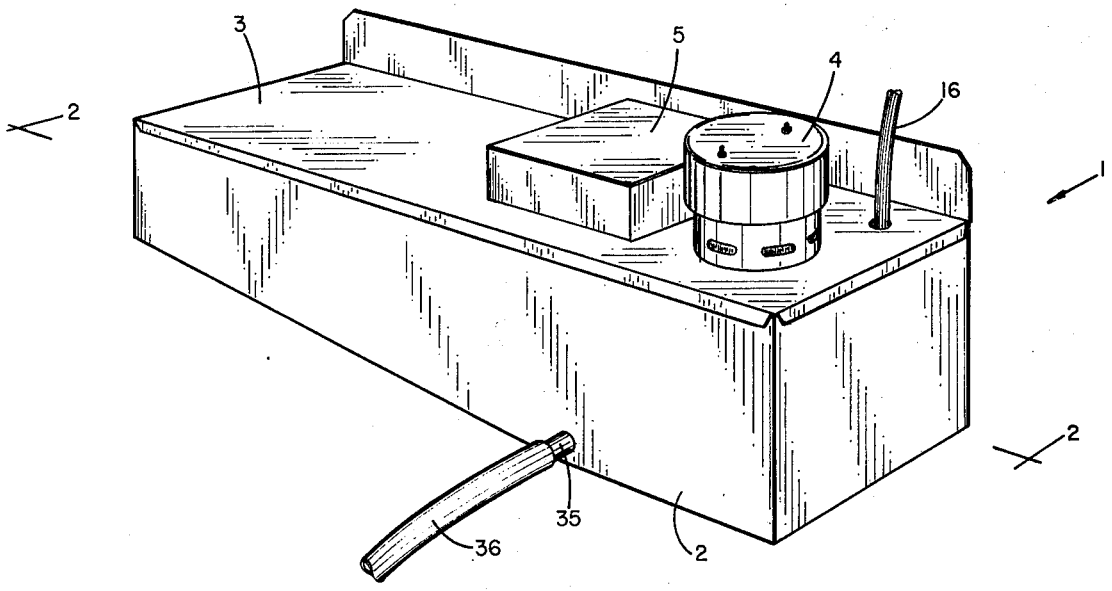
FIG. 1 is a perspective view of the slushing unit with the pump unit in place.
Figure 2:
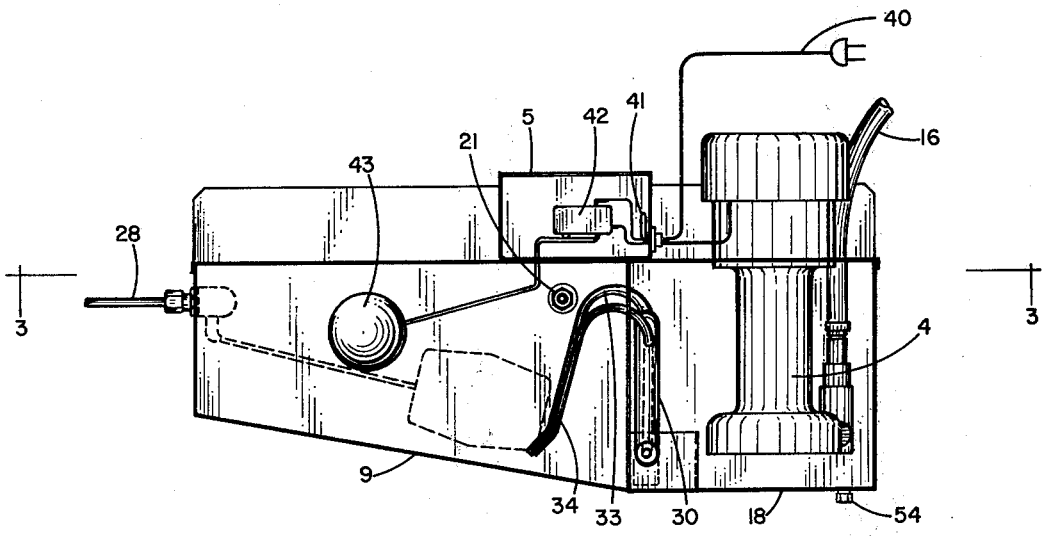
FIG. 2 is a sectional side view of the unit showing the timing well and circulating water sump taken along section line 2—2.

Referring to FIG. 1, automatic flushing device 1 consists of bottom container portion 2 and removable cover 3. Water pump 4 and housing 5 for various electrical components are mounted on the cover.

The bottom container is water tight and is separated into two discrete chambers 6 and 7. Chamber 6 is the timing reservoir and has side walls 10 and 11 coextensive in height with the outside walls 12, 13, 14, and 15, of the container. Chamber 7 is the main water sump, and is further divided by a low barrier 8. The barrier simply serves to collect rust, insoluble salts, dirt, aspen fiber particles, and the like, which are collected in the system and accumulate at the lower end of slanted floor portion 9. This debris settles in front of the barrier 8 and is flushed away when the system empties. A level portion 18 of the floor supports the sump on a horizontal surface.

Figure 4:
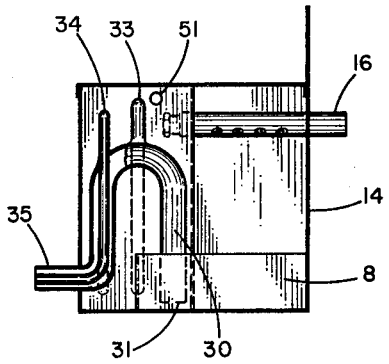
FIG. 4 is a front sectional view of the bottom portion of the device taken along section lines 4—4.
Figure 5:
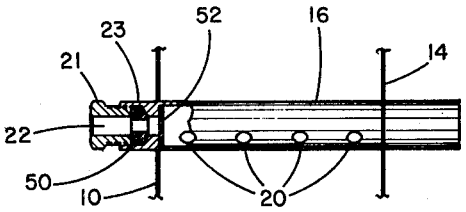
FIG. 5 is a partial sectional view of the water return tube and timing well inlet.

Water is circulated to the evaporative cooler (not shown) from the pump inlet (not shown) in the bottom of centrifugal pump 4 through flexible plastic tubing 16. Water returns to the flushing unit from the evaporative cooler through tubing 16 which extends into the unit through side wall 14, and chamber 7 and into reservoir 6. The water return tube is best seen in FIGS. 4 and 5, and has a series of downwardly oriented orifices 20 through which water pours back into sump 7. An additional optional small hole (not shown) may be drilled in the bottom of the tube to assure that no water will be left in the tube to evaporate if the unit is shut down for an extended period of time.

A male threaded plug 21 having an axial bore 22 is screwed into threaded end 23 of tube 16. Accordingly, water returning from the cooler passes into sump chamber 7 (through orifices 20), and also into timing reservoir 6 through screen 52 and bore 22. The relative quantities of water entering each chamber (and therefore the time interval between flushes) is easily adjusted by threading a different plug having a larger or smaller bore in the end of tube 16, or by replacing plastic washer 50 with a washer having a larger or smaller diameter. If desired, a length of capillary tubing could be used in place of the plug.

Water level is maintained at a relatively constant level in sump 7 by float valve 25 operated by float 26 on pivoted lever arm 27. The float valve is connected to makeup water line 28.

Figure 3:
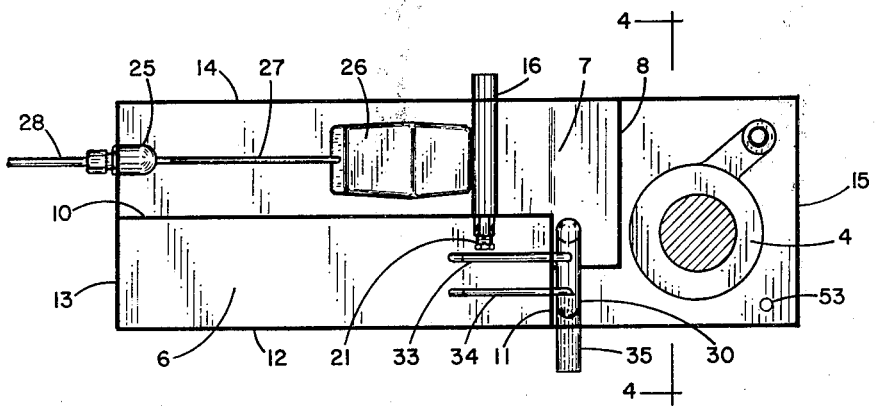
FIG. 3 is a top sectional view of the unit taken along section lines 3—3.

Arrangement of the siphon mechanism is very important to the invention. The main siphon tube 30 is an inverted U-shaped hollow tube having its main inlet 31 located near the bottom 18 of the lowest portion of the main sump 7. The siphon is located near the barrier 8 on the "upstream" side of the barrier so as to flush out any solids which have collected in the system. The top of the U is located at a level approximately $\frac{2}{3}$ to $\frac{3}{4}$ of the height of the outside container walls. The main siphon also has an additional inlet in the form of tube 33 which is welded or otherwise attached to the siphon tube, extending through wall 11 and having its open end located near the bottom of the timing reservoir. A third siphon tube 34 is generally coextensive with tube 33, extending through wall 11 and into the main tube 30. However, rather than terminating at its junction with the main tube as does tube 33, tube 34 continues integrally inside of main tube 30 to its drain portion 35 as is shown in FIGS. 3 and 4. Flexible hose 36 is attached to the siphon exit; the end of the hose is maintained at a level below the bottom of the sump to ensure proper siphon action. A small orifice 51 in wall 11 exists at a height slightly above tubes 33 and 34 to act as an overflow in the event the unit shuts down and the float 43 does not operate to shut off the pump.

The pump is operated electrically from a conventional power source, with the attachment shown schematically as plug 40. The pump is actuated manually by on-off switch 41, and by a float operated contact switch 42. Lever-operated float 43 turns off the pump via switch 42 when the timing chamber reaches a preset water level.

Operation of the system is as follows: In startings, water enters the makeup line 28 until the float valve 25 shuts off. The pump may be manually actuated with on-off switch 41. Alternatively, the unit may be wired to automatically cycle on and off with the air-conditioner. As water is pumped to the evaporative cooler, additional makeup water enters until an approximate steady-state condition is reached. As water circulates, the small bleed stream of returning water slowly fills timing reservoir 6. After the set period of time (which may be 12 hours, 24 hours, or even a week), the water level rises to the height of the float 43, actuating microswitch 42 and shutting off the pump. At this time, all water circulating in the system returns to sump 7, raising the level of water to a point above the top of siphon tube 30, forcing water to flow through the tube and out exit 35. The siphon effect will also drain the timing chamber through tubes 33 and 34, using the Bernoulli principle.

The sump can be manually emptied through drainhole 53 which is normally sealed with plug 54. Should for any reason the main siphon tube inlet 31 begin to draw air before the timing reservoir is empty, the timing reservoir will continue to flush through tube 34, which acts as an independent siphon. When both chambers have been flushed, fresh water returns through line 28 and the pump is automatically actuated by the dropping of float 43.

The system, in addition to flushing automatically at adjustable predetermined intervals, will also flush whenever the pump is manually shut off. When switch 41 is turned off, water in the system drains into sump 7 to a level above the siphon tube, actuating the flushing system and substantially emptying both chambers.

For units used in conjunction with air-conditioning precoolers, the unit can be wired to cycle on and off with the air-conditioner. However, it is preferable to have the unit separately controlled by its own thermostat; this will preclude the unit from flushing each time the air-conditioner shuts off.

Many advantages have been found to accrue to the user of the claimed system. Water consumption is sharply reduced, fewer alkali and particulates accumulate in the system, rust is reduced, pump life is increased, cooler pad life is increased, and maintenance is reduced.

Materials of construction, dimensions, and the like can vary with each installation and are obvious to one skilled in the art. In addition, many modifications can be made to the system within the spirit and scope of the invention. For example, the timing reservoir bleed stream may be immediately taken off the pump outlet 16 rather than being taken from the cooler return. Accordingly, the invention should be limited only by the following claims.

I claim:

1. In a circulating water system wherein water is pumped from and returned to a sump, the system including a make-up water supply source, means for maintaining a constant water level in the sump, a circulating pump, and means for returning circulating water to the sump, the improvement therein which comprises a timing reservoir separate from and adjacent to the sump, means for supplying a constant flow of a portion of the circulating water to the timing reservoir, and a siphon drain having inlet means near the bottom of the sump and separate inlet means near the bottom of the timing reservoir, drain outlet means for removing water from the sump, and conduit means connecting the inlet means with the outlet means, such that both the sump and timing reservoir are simultaneously drained when the water level in either reservoir reaches a predetermined level.

2. The system of claim 1 wherein the improvement also comprises a separate siphon tube having an intake portion located near the bottom of the timing reservoir and an outlet portion communicating with the drain.

3. The system of claim 2 wherein the siphon drain has outlet means for removing water from the sump, and the outlet portion of the separate siphon tube extends into and communicates with the outlet means of the siphon drain.

4. The system of claim 1 wherein the improvement also comprises switch means for automatically shutting off the circulating pump when the water level in the timing reservoir reaches a predetermined level.

5. The system of claim 4 wherein the switch means comprises a float-actuated microswitch.

6. The system of claim 1 wherein the sump has collecting means for accumulating any particulate matter in the system, and the inlet means for the siphon drain is located adjacent the collecting means such that the particulate matter is swept out of the system when the siphon is actuated.

7. The system of claim 6 wherein the sump has a floor having a level portion for supporting the sump on a horizontal surface and an upwardly sloped portion, and the system also comprises conduit means for returning circulating water to the sloped portion of the floor.

8. The system of claim 1 wherein the means for supplying water to the timing reservoir comprises a conduit, and means for adjusting the flow through the conduit.

* * * * *